United States Patent [19]

Trone

[11] Patent Number: 4,961,397

[45] Date of Patent: Oct. 9, 1990

[54] CHALLENGE CRAFT

[76] Inventor: Gordon Trone, 1153 Cozumel, Cypress, Calif. 90630

[21] Appl. No.: 205,375

[22] Filed: Jun. 10, 1988

[51] Int. Cl.[5] ..... B63B 7/00

[52] U.S. Cl. ..... 114/347; 114/354

[58] Field of Search ..... 114/347, 354, 352, 353, 114/358, 357

[56] References Cited

U.S. PATENT DOCUMENTS

| | | | |
|---|---|---|---|
| 3,075,207 | 1/1963 | Lewis | 114/354 |
| 4,004,307 | 1/1977 | Hermann | 114/354 |
| 4,274,170 | 6/1981 | Simpson | 114/354 |
| 4,730,573 | 3/1988 | Koon | 114/353 |

FOREIGN PATENT DOCUMENTS

| | | | |
|---|---|---|---|
| 939201 | 1/1974 | Canada | 114/354 |

*Primary Examiner*—Sherman D. Basinger
*Assistant Examiner*—Edwin L. Swinehart
*Attorney, Agent, or Firm*—Michael R. Collins

[57] ABSTRACT

The challeng craft is a paddle craft constructed of wood, plastic, and cloth with two wood interior support frames which are removable. The hull of the paddle craft is constructed of four pieces of wood attached with cloth so that when the interior support frames are removed the craft is foldable. This makes transportation of the craft easy. The paddle craft also had closed cell foam sponsons along the sides of the craft to provide stability in water.

1 Claim, 1 Drawing Sheet

CHALLENGE CRAFT

FIELD OF INVENTION

The present invention provides a design of a paddle craft which has more stability than the conventional canoe or kayak. The design also allows the craft to be folded making transportation and storage simple.

DESCRIPTION OF PRIOR ART

Conventional canoes and kayaks are rigid structures and although most are light weight the crafts are usually difficult to transport. The challenge craft however is designed so that the craft is easily folded into a convenient package. This foldable characteristic is one of the unique features of the craft which make it easier to use than other crafts.

The second aspect which improves the desgin over conventional canoes and kayaks is the closed cell foam sponson runners which stabilize the challenge craft.

The current invention improves the design of canoes and kayaks through a design which allows the craft to be folded and by foam sponson runners which improve stability in water compared to conventional craft.

SUMMARY OF OBJECTIVES OF THE INVENTION

A primary object of the present invention is to improve the design of canoes and kayaks. The design allows easy assembly and unassembly of the craft. The design also utilizes foam sponson runners which stabilize the craft to a greater degree than that of conventional crafts.

In accordance with the description present herein other objects of this invention will become apparent when the description and drawings presented herein are reviewed.

DESCRIPTION OF THE PREFERRED EMBODIMENT

Figure 1:
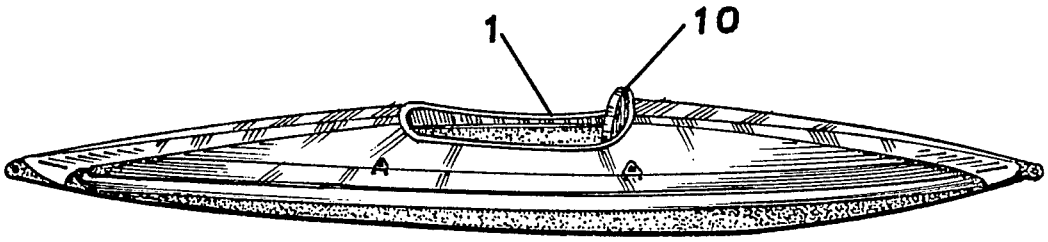
FIG. 1: Illustrates a side view of the challenge craft.
Figure 2:
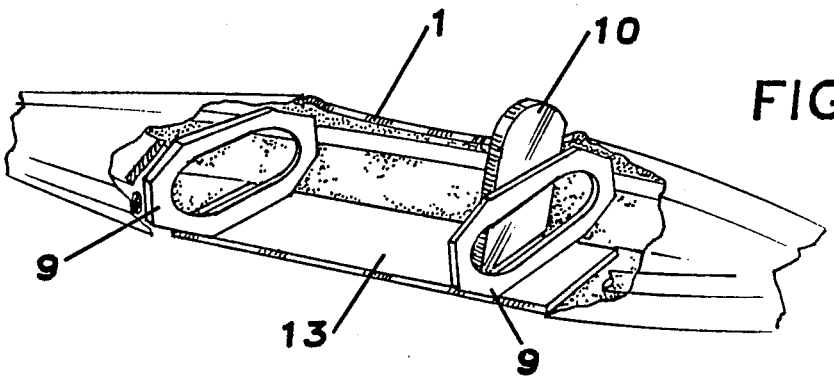
FIG. 2: Illustrates a side-sectional view of the challenge craft.
Figure 3:
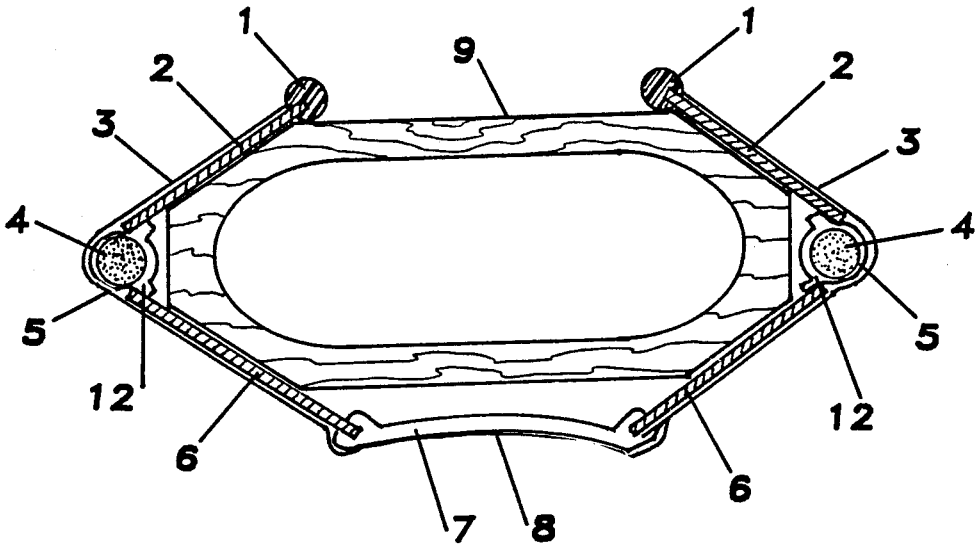
FIG. 3: Illustrates a cross-sectional view of the challenge craft as viewed from the front of the craft.

The challenge craft is comprised of a hull with a stabilizing design and a place for the paddler to ride.

The hull of the craft is shaped by two wood station molds (9). The wood station molds (9) are approximately one half inch thick and are the support frame for the hull. There are two wood station molds (9). One is located behind the seat cushion (10) and the other approximately three to four feet in front of the seat (10).

Surrounding and forming the shell of the challenge craft is four pieces of wood. The craft has two topside wood (2) pieces and two bottom side (6) wood pieces. The wood pieces (2), (6) are attached by nylon fabric (12) inside the sponson (4). The bottom wood (6) pieces are also connected by nylon fabric (7). The nylon fabric (7) at the bottom has a urethane rubber coating (8) for protection and the plywood sides (2), (6) are covered with plastic lamination (3). This ensures the craft is water resistant. The nylon fabric bottom (7) and nylon fabric (12) is the characteristic of the design which enables to craft to be folded after the wood station mold (9) in the interior is removed.

The wood moldings (9) are attached to a bottom plate (13) and to the wood topside (2) pieces with velcro or a similar attachment means. The paddler sits on the bottom plate (13). Around the rim of the top is a plastic cockpit edge (1). A cushion seat (10) is placed in the craft so that the paddler can ride lean back.

To provide stability the craft is outfitted with closed cell foam sponsons (4) which are attached along each side of the craft. The foam sponsons (4) are covered with edge covers (5). The foam sponsons (4) enable the craft to float even when filled with water.

I claim:

1. A foldable hull for a kayak, said hull comprising a left topside piece, a right top-side piece, a left bottom side piece, and a right bottom side piece, Flexible fabric connectors interposed between and connecting the left bottom side piece to the left top-side piece, the right bottom side piece to the right top-side piece, and the left bottom side piece to the right bottom side piece, and wherein the fabric connectors are waterproof, a water resistant lamnation covering the hull pieces to make the hull water resistant, removable forward and rearward wood moldings, each for supporting the left and right top-side pieces and the left and right bottom side pieces, to provide the hull with a diamond-shape in cross-section, the moldings when removed from the hull, allowing the hull to be folded, a bottom plate on which a paddler sits, the removable forward and rearward moldings being adapted to be attached to the left and right top-side pieces and the bottom plate to secure the removable forward and rearward moldings in place, a foam pad adapted to be positioned against the removable rear molding to provide a back rest, and foam elements on sides of the hull which are flexible and provide stability for the hull when in water.

* * * * *